US005800159A

United States Patent [19]

Maughan et al.

[11] Patent Number: 5,800,159

[45] Date of Patent: Sep. 1, 1998

[54] ATMOSPHERIC GAS BURNER ASSEMBLY FOR IMPROVED FLAME STABILITY

[75] Inventors: James Rollins Maughan, Scotia, N.Y.; James Kellogg Nelson, Long Beach, N.C.

[73] Assignee: General Electric Company, Schenectady, N.Y.

[21] Appl. No.: 774,976

[22] Filed: Dec. 26, 1996

[51] Int. Cl.[6] ..... F23D 14/06; F23D 14/58

[52] U.S. Cl. ..... 431/349; 431/114; 431/350; 431/354; 431/266; 126/39 R; 126/39 E

[58] Field of Search ..... 431/263, 266, 431/350, 349, 354; 126/39 E, 39 R

[56] References Cited

U.S. PATENT DOCUMENTS

| | | | |
|---|---|---|---|
| 2,220,247 | 11/1940 | Kochendorfer et al. | 431/349 |
| 3,796,535 | 3/1974 | De Gouville . | |
| 4,757,801 | 7/1988 | De Gouville et al. . | |
| 5,104,311 | 4/1992 | Maughan et al. . | |
| 5,133,658 | 7/1992 | De Gouville et al. . | |
| 5,246,365 | 9/1993 | Himmel et al. . | |
| 5,408,984 | 4/1995 | Maughan . | |
| 5,464,004 | 11/1995 | Maughan . | |
| 5,488,942 | 2/1996 | Maughan . | |
| 5,494,027 | 2/1996 | Maughan . | |

*Primary Examiner*—Carl D. Price
*Attorney, Agent, or Firm*—Patrick K. Patnode; Marvin Snyder

[57] ABSTRACT

A gas burner assembly for connection to a gas source includes a burner body having a sidewall and a main gas conduit. The burner body further includes a number of primary burner ports disposed within the sidewall, each for supporting a respective main flame, and a simmer flame port disposed within the sidewall adjacent to the primary burner ports for supporting a simmer flame. Additionally, a main fuel chamber is disposed within the burner body to provide fuel to the primary burner ports, and a stability chamber is disposed within the burner body to channel fuel to the simmer flame port. In one configuration, the stability chamber has one or more stability inlets proximate the burner throat which provide the stability chamber with fuel by utilizing the static pressure associated with each stability inlet. In another configuration, the stability chamber has a small feed hole located proximate the burner throat of the main gas conduit. Each configuration creates a comparatively large pressure drop across the stability chamber during fuel flow due to the positioning of the stability inlets or the feed hole proximate the burner throat, thereby reducing the sensitivity of the simmer flame to pressure disturbances.

19 Claims, 4 Drawing Sheets

ATMOSPHERIC GAS BURNER ASSEMBLY FOR IMPROVED FLAME STABILITY

BACKGROUND OF THE INVENTION

This application relates to atmospheric gas burners, and in particular relates to improvements in gas burner flame stability.

Atmospheric gas burners are commonly used as surface units in household gas cooking appliances. A significant factor in the performance of gas burners is their ability to withstand airflow disturbances in the surroundings, such as room drafts, rapid movement of cabinet doors, and most commonly rapid oven door manipulation. Manipulation of the oven door is particularly troublesome because rapid openings and closings of the oven door often produce respective under-pressure and over-pressure conditions within the oven cavity. Since the flue, through which combustion products are removed from the oven, is sized to maintain the desired oven temperature and is generally inadequate to supply a sufficient air flow for re-equilibration, a large amount of air passes through or around the gas burners.

This surge of air around the gas burners, due to over pressure or under pressure conditions in the oven cavity, is detrimental to the flame stability of the burners and may cause extinction of the flames. This flame stability problem is particularly evident in sealed gas burner arrangements, referring to the lack of an opening in the cooktop surface around the base of the burner to prevent spills from entering the area beneath the cooktop.

The inherent cause of this flame instability is the low pressure drop of the fuel/air mixture passing through the burner ports of a typical rangetop burner. Although there is ample pressure available in the fuel, the pressure energy is used to accelerate the fuel to the high injection velocity required for primary air entrainment. Relatively little of this pressure is recovered at the burner ports. A low pressure drop across the ports allows pressure disturbances propagating through the ambient to easily pass through the ports, momentarily drawing the flame towards the burner head and leading to thermal quenching and extinction.

An additional problem is that rapid adjustments of the fuel supply to a gas burner from a high burner input rate to a low burner input rate often will cause flame extinction when the momentum of the entrained air flow continues into the burner even though fuel has been cut back, resulting in a momentary drop in the fuel/air ratio, causing extinction.

Some commercially available gas burners employ dedicated expansion chambers to attempt to improve stability performance. These expansion chambers are intended to damp flow disturbances before such disturbances reach a respective stability flame. This damping is typically attempted by utilizing a large area expansion between an expansion chamber inlet and an expansion chamber exit, typically expanding by a factor of about ten. Accordingly, the velocity of a flow disturbance entering a burner throat is intended to be reduced by a factor of about ten prior to reaching a respective stability flame, thereby reducing the likelihood of flame extinction. Large area expansion and disturbance damping are not typically present in conventional main burner ports, making conventional main burner ports susceptible to flame extinction, especially at low burner input rates. Simmer stability is generally improved as the area expansion ratio is increased. If an expansion chamber inlet is sized too small, however, the gas entering an expansion chamber may be insufficient to sustain a stable flame at the expansion chamber port.

Commercially available gas burners, such as those described in U.S. Pat. No. 5,133,658 and U.S. Pat. No. 4,757,801, each issued to Le Monnier De Gouville et al., employ an expansion chamber to improve flame stability. The De Gouville gas burners have a plenum ahead of a number of main burner ports. An expansion chamber inlet is located in the plenum, adjacent the main flame ports. When a negative pressure disturbance enters the burner (suction, for example, from the opening of an oven door), the pressure drop and flow velocity through the main burner ports are momentarily reduced causing unwanted extinction of the main burner flames. The expansion chamber flame, however, is less susceptible to extinction due to the damping effect described earlier. Although such gas burners having an expansion chamber provide somewhat improved stability performance at simmer settings, disturbances continue to cause unwanted extinction. Furthermore, these expansion chambers have excessively large flames at higher burner input rates.

Accordingly, there is a need for an atmospheric gas burner which is better able to withstand airflow disturbances, especially during low burner input rates.

SUMMARY OF THE INVENTION

In accordance with the invention, a gas burner assembly for connection to a gas source includes a burner body having a sidewall and a main gas conduit having an entry area and a burner throat. The burner body further includes a plurality of primary burner ports disposed within the sidewall, with each primary port configured to support a respective main flame, and a simmer flame port disposed within the sidewall adjacent to the primary burner ports. A stability chamber is disposed within the burner body so as to channel fuel to the simmer flame port. In one embodiment, the stability chamber has at least one stability inlet positioned near the burner throat of the main gas conduit which provides the stability chamber with fuel by utilizing the static pressure associated with each stability inlet. In another embodiment, the stability chamber has a small feed hole provided in the end wall at the burner throat of the main gas conduit.

During simmer operation each configuration creates a comparatively large pressure drop across the stability chamber inlet due to the positioning of the stability inlets or the feed hole proximate the burner throat, thereby reducing the sensitivity of the simmer flame to pressure disturbances. Moreover, because the stability chamber has a relatively large volume, i.e., the stability chamber radially extends from the burner throat to the stability flame port, there is a decrease in the tendency for a respective simmer flame to be extinguished when fuel/air input rate is rapidly adjusted, as the large volume of fuel/air within the stability chamber buffers the flame.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE INVENTION

Figure 1:
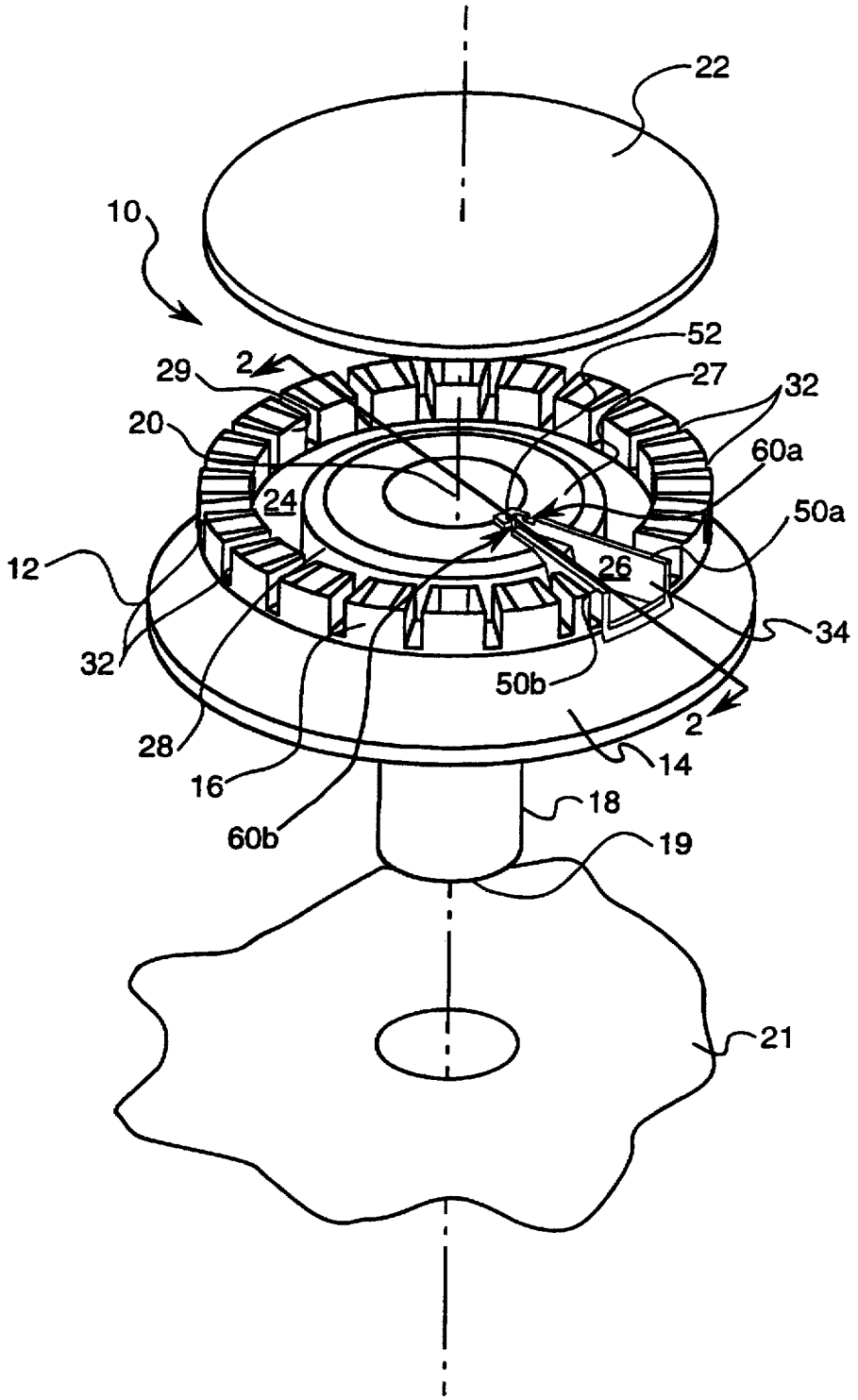
FIG. 1 is an exploded perspective view of a gas burner assembly in accordance with this invention.
Figure 2:
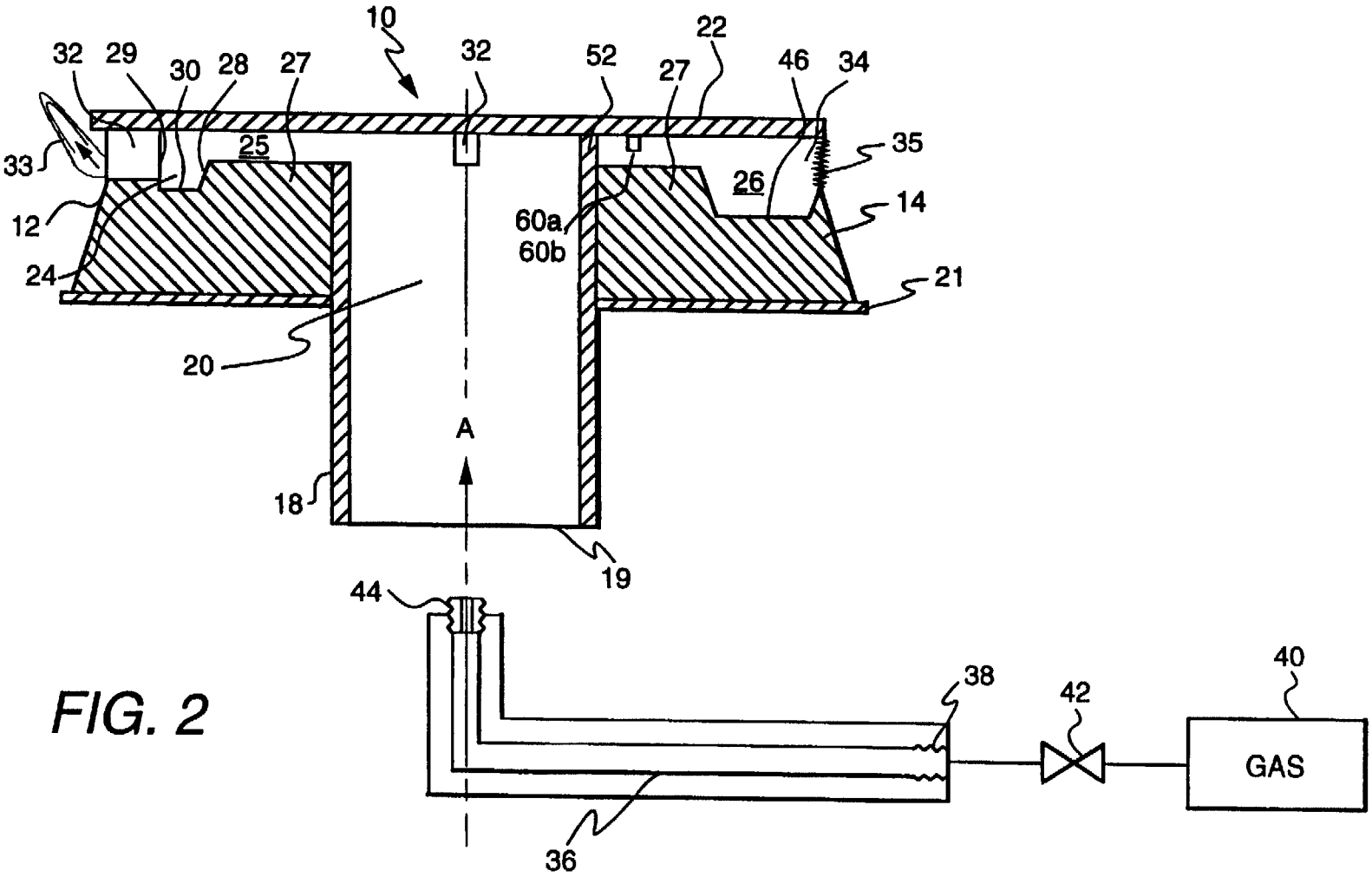
FIG. 2 is a cross-sectional plan view through line 2—2 of FIG. 1, in accordance with this invention.

An atmospheric gas burner assembly 10 includes a burner body 12 having a frustrum-shaped solid base portion 14 and a cylindrical sidewall 16 (FIG. 1) extending axially from the periphery of base portion 14, as shown in the illustrative embodiment of FIGS. 1 and 2. A main gas conduit 18 having an entry area 19 and a burner throat region 20 is open to the exterior of burner body 12 and defines a passage which extends axially through the center of burner body 12 to provide fuel/air flow along path "A" (FIG. 2) to burner assembly 10. As used herein, the term "gas" refers to a combustible gas or gaseous fuel mixture.

Burner assembly 10 is attached, in a known manner, to a support surface 21 (FIG. 1) of a gas cooking appliance such as a range or a cooktop. A cap 22 is disposed over the top of burner body 12, defining therebetween an annular main fuel chamber 24, an annular diffuser region 25 (FIG. 2), and a stability chamber 26, typically wedge-shaped. A toroidal-shaped upper portion 27 of burner body 12, immediately bordering burner throat 20, in combination with cap 22 defines annular diffuser region 25 therebetween. Cap 22 can be fixedly attached to sidewall 16 (FIG. 1) or can simply rest on sidewall 16 for easy removal. While one type of burner is described and illustrated, the instant invention is applicable to other types of burners, such as stamped aluminum burners and separately mounted orifice burners.

Annular main fuel chamber 24 is defined by an outer surface 28 of toroidal shaped upper surface 27, an inner surface 29 of sidewall 16, an upper surface 30 (FIG. 2) of base portion 14, and cap 22. A plurality of primary burner ports 32 are disposed in sidewall 16 (FIG. 1) of burner body 12 so as to provide a path to allow fluid communication with main fuel chamber 24, each primary burner port 32 being adapted to support a respective main flame 33 (FIG. 2). Primary burner ports 32 are typically, although not necessarily, evenly spaced about sidewall 16. As used herein, the term "port" refers to an aperture of any shape from which a flame may be supported.

At least one simmer flame port 34 is disposed in sidewall 16 (FIG. 1) of burner body 12 so as to provide a path to allow fluid communication with stability chamber 26. Simmer flame port 34 is substantially isolated from main fuel chamber 24 and is adapted to support a simmer flame 35. Simmer flame port 34 is adjacent to primary burner ports 32 to provide a re-ignition source to primary burner ports 32 if flameout occurs. While a single simmer flame port 34 is shown in the drawings, the present invention may include one or more additional simmer flame ports 34. Typically, simmer flame port 34 has an open area five to fifteen times larger than a respective primary burner port 32.

A gas feed conduit 36 (FIG. 2) comprises a coupling 38 disposed on one end for connection to a gas source 40 via a valve 42 (shown schematically in FIG. 2). Valve 42 is controlled in a known manner by a corresponding control knob on the gas cooking appliance to regulate the flow of gas from gas source 40 to gas feed conduit 36. The other end of gas feed conduit 36 is provided with an injection orifice 44. Injection orifice 44 is aligned with main gas conduit 18 so that fuel, discharged from injection orifice 44, and entrained air are supplied to main fuel chamber 24 and stability chamber 26 via main gas conduit 18 along path "A" of FIG. 2.

In accordance with the instant invention, as shown in FIGS. 1 and 2, stability chamber 26 is substantially isolated from main fuel chamber 24 such that stability chamber 26 is not in immediate fluid communication with main fuel chamber 24 and is therefore relatively independent of primary burner ports 32. Stability chamber 26 is defined on each side by a pair of radially extending baffles **50*a* and 50*b* (FIG. 1), on the bottom by an upper surface 46 (FIG. 2) of burner body 12, and on the top by cap 22. An end wall 52 positioned proximate burner throat 20 further defines stability chamber 26 so as to substantially isolate stability chamber 26 from main fuel chamber 24. In one embodiment of the instant invention, as best shown in FIG. 2, upper surface 46 of burner body 12 is configured such that stability chamber 26 has a shallow depth at the narrow end of stability chamber 26 closest to burner throat 20 and transitions to a deeper, wider section when closest to simmer flame port 34**.

In accordance with one embodiment of the instant invention, stability chamber 26 further comprises two stability inlets **60*a* and 60*b*. Stability inlets 60*a*, 60*b* are disposed within respective baffles 50*a*, 50*b* such that stability inlets 60*a*, 60*b* are positioned so as to be substantially symmetrical on each side of stability chamber 26 proximate end wall 52 and correspondingly proximate burner throat 20. Stability inlets 60*a*, 60*b* are substantially perpendicular to the direction of the flow of gas radially outward from burner throat 20 and are tangentially fed the fuel/air mixture by static pressure at that location, as discussed below. The instant invention is not limited to two stability inlets 60*a*, 60*b*** and in fact, may include one or more stability inlets.

In accordance with the instant invention, stability inlet(s) **60*a*, 60*b* are positioned at burner throat 20**. This arrangement improves stability performance by permitting an effectively smaller stability chamber inlet to be utilized while retaining sufficient gas flow. Additionally, the instant invention creates an aesthetically pleasant reduced stability flame size at higher burner input rates, in a manner which can be best understood by considering the static pressure distribution in the burner head, as described below.

Figure 3B:
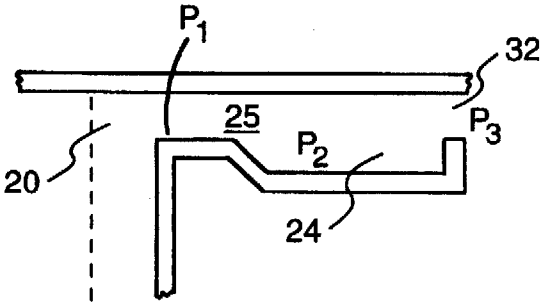
FIG. 3B is a fragmentary cross-sectional plan view through line 3—3 of the gas burner assembly of FIG. 3A.
Figure 3C:
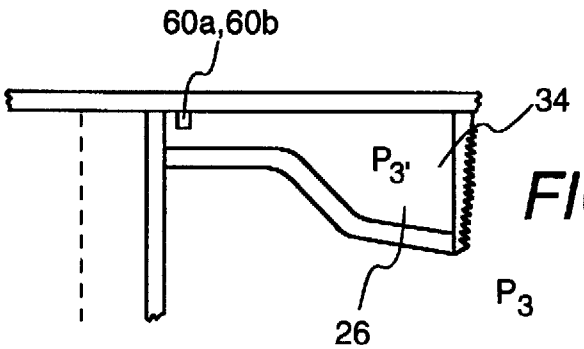
FIG. 3C is a fragmentary cross-sectional plan view through line 4—4 of the gas burner assembly of FIG. 3A.
Figure 3A:
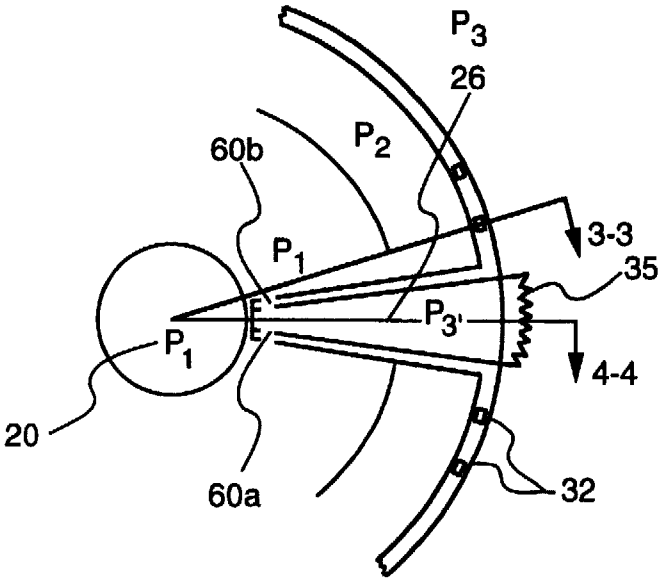
FIG. 3A is a fragmentary cross-sectional top view of a gas burner assembly in accordance with this invention.

In FIGS. 3A–3C, $P_3$ depicts the static pressure in the ambient surrounding the gas burner, normally atmospheric pressure. Pressure $P_3'$ depicts the static pressure within stability chamber 26, which pressure is approximately equal to ambient pressure $P_3$, due in part to the low flow velocity and large exit area of stability chamber 26. Pressure $P_2$ depicts the pressure in main fuel chamber 24 between annular diffuser region 25 and primary burner ports 32. Pressure $P_2$ is higher than static pressure $P_3$ due to pressure drop across primary burner ports 32. The pressure difference between $P_2$ and $P_3$ forces the fuel/air flow through primary burner ports 32, and in commercially available expansion chambers (See De Gouville et al. above), drives flow into the expansion chamber as well. Pressure $P_1$ is the static pressure at the entrance to annular diffuser region 25. At low burner input rates, where burner velocities are low, friction between the laminar gas flow and the burner becomes significant, and causes static pressure $P_1$ to be significantly higher than pressure $P_2$. Consequently, the pressure drop from $P_1$ to $P_3'$ is larger than from $P_2$ to P3. In one embodiment, the static pressure drop from $P_1$ to $P_3'$ is 40% higher than from $P_2$ to $P_3$ at simmer. Consequently, during simmer, for the same size inlet to stability chamber 26, as compared to commercially available expansion chambers, simmer flame 35 is larger, improving simmer stability. Similarly, for the same gas flow rate, stability inlet(s) 60*a*, 60*b* may be sized smaller, also improving stability relative to commercially available burners, as discussed above.

At higher burner input rates, the relatively high velocity of the gas flow results in a significant decrease in static pressure, in accordance with well known fluid principles. Consequently, at higher burner input rates, the static pressure at $P_1$ is lower than at $P_2$, where the velocity is low even at high burner input rates due to the large area. In fact, the burner design can be manipulated by changing the area of annular diffuser region 25 to create a static pressure $P_1$ which is less than ambient pressure $P_3$. The decrease in static pressure at $P_1$ causes simmer flame 35 to decrease in size as the gas input rate increases, allowing simmer flame 35 to be relatively large under simmer operation without being excessively large or unsightly at higher burner input rates.

In operation, a control knob on the gas cooking appliance which corresponds to the desired gas burner assembly 10 is manipulated, thereby causing valve 42 (FIG. 2) to provide fuel to gas feed conduit 36. The fuel is discharged from injection orifice 44 and primary air is entrained to support combustion. The fuel/air mixture enters entry area 19 of main gas conduit 18 and flows along path "A" to burner throat 20 through annular diffuser region 25 to main fuel chamber 24, which main fuel chamber 24 supplies the fuel/air mixture to primary burner ports 32 for combustion by main flames 33. Additionally, the fuel/air mixture tangentially feeds from burner throat 20 through stability inlets 60*a*, 60*b* to simmer port 34 for combustion by simmer flame 35.

If the control knob is manipulated to a position corresponding to high input, fuel/air flow increases into main gas conduit 18 and correspondingly increases into main fuel chamber 24, producing larger flames at primary burner ports 32, thereby creating the desired larger cooking flames. The flow into stability chamber 26, however, due to low static pressures, as discussed above, is relatively low and a small simmer flame is produced at simmer flame port 34. In most commercially available burner assemblies, relatively large simmer flames are produced during high burner input rates, however, in the instant invention a relatively smaller aesthetically pleasing simmer flame is produced. During operations at high burner input rates burner assembly 10 is relatively immune to stability problems due to the shear velocities and quantities of fuel entering burner assembly 10.

If the control knob is manipulated to a position corresponding to low input, fuel/air flow decreases into main gas conduit 18 and correspondingly decreases into main fuel chamber 24 producing smaller main flames 33 at primary burner ports 32 creating the desired lower cooking flames. The flow into stability chamber 26, however, due to high static pressures, as discussed above, is relatively high and a stable simmer flame 35 is produced at simmer flame port 34. During operations at low burner input rates, when most commercially available burner assemblies, such as those described above, are susceptible to pressure disturbances propagating through the ambient or through the oven chamber, stability chamber 26 maintains simmer flame 35 in a stable form due to the large pressure drop across stability chamber 26. This large pressure drop across stability chamber 26 is due to the placement of stability inlets 60*a*, 60*b* proximate burner throat 20, and due to the relatively large volume of stability chamber 26.

Figure 4:
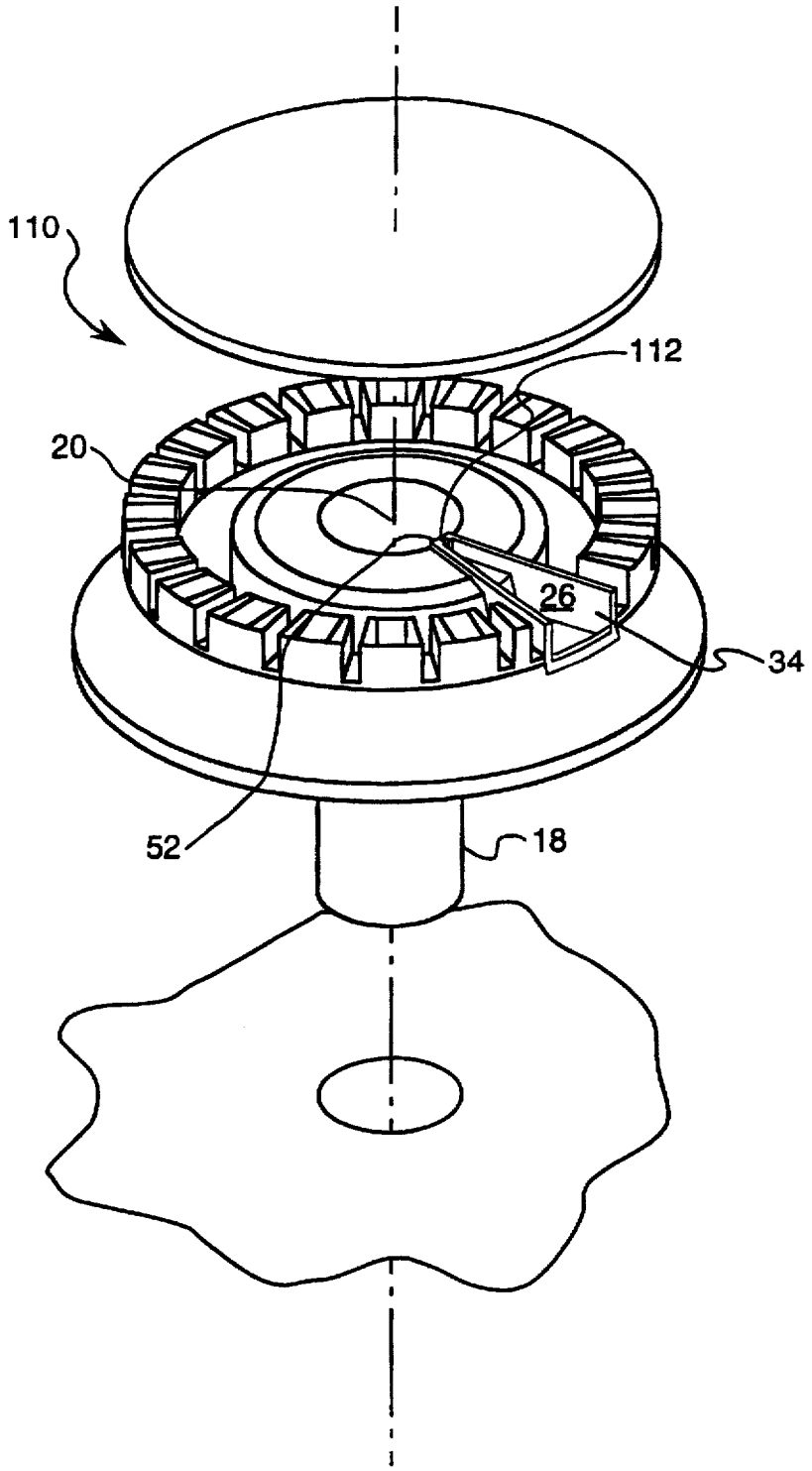
FIG. 4 is an exploded perspective view of a gas burner assembly in accordance with another embodiment of this invention.

FIG. 4 shows an atmospheric gas burner assembly 110 which is another embodiment of the instant invention. Gas burner assembly 110 is similar in all respects to gas burner assembly 10 except that stability chamber 26 further comprises a feed hole 112 positioned in end wall 52 at burner throat 20 of main gas conduit 18 for providing gas flow from gas feed conduit 36 (FIG. 2) to stability chamber 26 to support a simmer flame 35 at simmer flame port 34. Feed hole 112 replaces stability inlets 60*a*, 60*b* of burner assembly 10 (FIG. 1). Stability chamber 26 radially extends from feed hole 112 to simmer flame port 34.

Flow moving upward along path "A" entering throat region 20 stagnates near feed hole 112, creating a relatively high local pressure. This local pressure allows feed hole 112 to be sized relatively small, thereby significantly improving stability of simmer flame 35.

While only certain features of the invention have been illustrated and described herein, many modifications and changes will occur to those skilled in the art. It is, therefore, to be understood that the appended claims are intended to cover all such modifications and changes as fall within the true spirit of the invention.

We claim:

1. A gas burner assembly for connection to a source of gas, said gas burner assembly comprising:

a burner body having a sidewall and a tubular main gas conduit, said tubular main gas conduit having an inlet and an outlet;

a plurality of primary burner ports disposed within said sidewall so as to be in communication with said outlet of said tubular main gas conduit;

a simmer flame port disposed within said sidewall in a spaced relation with said primary burner ports for providing a reignition source therefore;

a stability chamber disposed within said burner body, said stability chamber defined on each side by a pair of radially extending baffles, on the bottom by an upper surface of said burner body, on the top by a cap, and by an end-wall at said outlet so as to extend from said outlet to said simmer flame port, and at least one stability inlet disposed within at least one of said baffles such that said stability inlet is substantially perpendicular to a direction of gas flow radially outward from said outlet, said stability inlet being disposed proximate said outlet so as to create a large flame stabilizing pressure drop across said stability chamber.

2. A gas burner assembly, in accordance with claim 1, wherein said upper surface of said burner body is configured such that a depth of said stability chamber at an end of said stability chamber closest said outlet has a value less than a depth of said stability chamber at an end closest to said simmer flame port.

3. A gas burner assembly, in accordance with claim 1, wherein said stability inlets are positioned substantially symmetrical on each side of said stability chamber proximate said end-wall.

4. A gas burner assembly, in accordance with claim 1, further comprising a gas feed conduit connected to a gas source via a valve at a first end and comprising an injection orifice at a second end, said injection orifice being aligned with said main gas conduit such that fuel discharged from said injection orifice and entrained air are supplied to said gas burner assembly.

5. A gas burner assembly, in accordance with claim 1, wherein at low burner input rates, the static pressure at said stability inlets is relatively high and a relatively large amount of fuel air mixture enters said stability chamber, and at high burner input rates, the static pressure at said stability inlets is relatively low and a lesser amount of fuel air mixture enters said stability chamber.

6. A gas cooking appliance comprising:

a gas burner assembly for connection to a source of gas, said gas burner assembly comprising a burner body having a sidewall and a tubular main gas conduit, said tubular main gas conduit having an inlet and an outlet, a plurality of primary burner ports disposed within said sidewall so as to be in communication with said outlet of said tubular main gas conduit, a simmer flame port disposed within said sidewall adjacent to said primary burner ports for providing a reignition source therefore, a stability chamber disposed within said burner body, said stability chamber defined on each side by a pair of radially extending baffles, on the bottom by an upper surface of said burner body, on the top by a cap, and by an end-wall at said outlet so as to extend from said outlet to said simmer flame port, and at least one stability inlet disposed within at least one of said baffles such that said stability inlet is substantially perpendicular to a direction of gas flow radially outward from said outlet, said stability inlet being disposed proximate said outlet so as to create a large flame stabilizing pressure drop across said stability chamber.

7. A gas cooking appliance, in accordance with claim 6, wherein said upper surface of said burner body is configured such that a depth of said stability chamber at an end of said stability chamber closest said outlet has a value less than a depth of said stability chamber at an end closest to said simmer flame port.

8. A gas cooking appliance, in accordance with claim 6, wherein said stability inlets are positioned substantially symmetrical on each side of said stability chamber proximate said end-wall.

9. A gas cooking appliance, in accordance with claim 6, further comprising a gas feed conduit connected to a gas source via a valve at a first end and comprising an injection orifice at a second end, said injection orifice being aligned with said main gas conduit such that fuel discharged from said injection orifice and entrained air are supplied to said gas burner assembly.

10. A gas cooking appliance, in accordance with claim 6, wherein at low burner, input rates, the static pressure at said stability inlets is relatively high and a relatively large amount of fuel air mixture enters said stability chamber, and at high burner input rates, the static pressure at said stability inlets is relatively low and lesser amount of fuel enters said stability chamber.

11. A gas burner assembly for connection to a source of gas, said gas burner assembly comprising:

a burner body having a sidewall and a tubular main gas conduit, said tubular main gas conduit having an inlet and an outlet;

a sidewall extending between said cap and said body at the periphery of said body;

a burner cap;

a plurality of primary burner ports disposed within said sidewall so as to be in communication with said outlet of said tubular main gas conduit;

a simmer flame port disposed within said sidewall in a spaced relation with said primary burner ports for providing a reignition source therefore;

a stability chamber disposed within said burner body, said stability chamber defined on each side by a pair of radially extending baffles, on the bottom by an upper surface of said burner body, on the top by a cap, by an end-wall at said outlet so as to extend from said outlet to said simmer flame port, and at least one stability inlet disposed within at least one of said baffles such that said stability inlet is substantially perpendicular to a direction of gas flow radially outward from said outlet, said stability inlet being disposed proximate said outlet so as to create a large flame stabilizing pressure drop across said stability chamber.

12. A gas burner assembly, in accordance with claim 11, wherein said upper surface of said burner body is configured such that a depth of said stability chamber at an end of said stability chamber closest said outlet has a value less than a depth of said stability chamber at an end closest to said simmer flame port.

13. A gas burner assembly, in accordance with claim 11, wherein said stability inlets are positioned substantially symmetrical on each side of said stability chamber proximate said end-wall.

14. A gas burner assembly, in accordance with claim 11, further comprising a gas feed conduit connected to a gas source via a valve at a first end and comprising an injection orifice at a second end, said injection orifice being aligned with said main gas conduit such that fuel discharged from said injection orifice and entrained air are supplied to said gas burner assembly.

15. A gas burner assembly, in accordance with claim 11, wherein at low burner input rates, the static pressure at said stability inlets is relatively high and a relatively large amount of fuel air mixture enters said stability chamber, and at high burner input rates, the static pressure at said stability inlets is relatively low and a lesser amount of fuel air mixture enters said stability chamber.

16. A gas burner assembly for connection to a source of gas, said gas burner assembly comprising:

a burner body having a sidewall and a tubular main gas conduit, said tubular main gas conduit having an inlet and an outlet;

a plurality of primary burner ports disposed within said sidewall so as to be in communication with said outlet of said tubular main gas conduit;

a simmer flame port disposed within said sidewall in a spaced relation with said primary burner ports for providing a reignition source therefore;

a stability chamber disposed within said burner body, said stability chamber defined on each side by a pair of radially extending baffles, on the bottom by an upper surface of said burner body, on the top by a cap, by an end-wall at said outlet so as to extend from said outlet to said simmer flame port, and a feed hole disposed within said end-wall proximate said outlet so as to create a large flame stabilizing pressure drop across said stability chamber.

17. A gas burner assembly, in accordance with claim 16, wherein said upper surface of said burner body is configured such that a depth of said stability chamber at an end of said stability chamber closest said burner throat has a value less than a depth of said stability chamber at an end closest to said simmer flame port.

18. A gas burner assembly, in accordance with claim 16, further comprising a gas feed conduit connected to a gas source via a valve at a first end and comprising an injection orifice at a second end, said injection orifice being aligned with said main gas conduit such that fuel discharged from said injection orifice and entrained air are supplied to said gas burner assembly.

19. A gas burner assembly, in accordance with claim 16, wherein at low burner input rates, the static pressure at said feed hole is relatively high and a relatively large amount of fuel air mixture enters said stability chamber, and at high burner input rates, the static pressure at said feed hole is relatively low and a lesser amount of fuel air mixture enters said stability chamber.

* * * * *